United States Patent [19]

Costello

[11] Patent Number: 4,627,344

[45] Date of Patent: Dec. 9, 1986

[54] IMPACT PRINTER WITH MAGNETIC INTERACTION COMPENSATION

[75] Inventor: Robert E. Costello, Utica, Mich.

[73] Assignee: Centronics Data Computer Corp., Hudson, N.H.

[21] Appl. No.: 721,994

[22] Filed: Apr. 11, 1985

[51] Int. Cl.[4] ..... B41J 1/20

[52] U.S. Cl. ..... 101/93.14; 101/93.03; 101/93.29

[58] Field of Search ..... 101/93.09, 93.14, 93.29, 101/93.03; 400/157.2, 157.3, 166

[56] References Cited

U.S. PATENT DOCUMENTS

| | | | |
|---|---|---|---|
| 4,232,975 | 11/1980 | Kane | 400/144.2 |
| 4,278,021 | 7/1981 | Nakano | 101/93.14 X |
| 4,280,404 | 7/1981 | Barrus | 101/93.29 X |
| 4,286,516 | 9/1981 | Wertanen | 101/93.14 X |
| 4,286,517 | 9/1981 | Katagiri | 101/93.14 |

*Primary Examiner*—Paul T. Sewell

*Attorney, Agent, or Firm*—Pahl, Lorusso & Loud

[57] ABSTRACT

In the high speed impact printer disclosed herein, the effects of magnetic interaction between adjacent magnetic actuators is offset or compensated for by providing a programmable delay in the energization of each magnet, the value of the delay being programmed as a predetermined function of the pattern of energization of physically adjacent coils.

7 Claims, 4 Drawing Figures

| INPUTS | | | | | |
|---|---|---|---|---|---|
| LATCH 2 | LATCH 4 | LATCH 6 | | DRIVER 2 | DRIVER 6 | PROGRAMABLE DELAY TIME |
| 1 | 1 | 1 | | 0 | 0 | 247μ Sec |
| 1 | 1 | 0 | | 0 | 0 | 208μ Sec |
| 0 | 1 | 1 | | 0 | 0 | 208μ Sec |
| 0 | 1 | 0 | | 0 | 0 | 156μ Sec |
| 0 | 1 | 0 | | 1 | 1 | 78μ Sec |
| 0 | 1 | 0 | | 1 | 0 | 117μ Sec |
| 0 | 1 | 0 | | 0 | 1 | 117μ Sec |
| 0 | 1 | 1 | | 1 | 0 | 156μ Sec |
| 1 | 1 | 0 | | 0 | 1 | 156μ Sec |

FIG. 4

IMPACT PRINTER WITH MAGNETIC INTERACTION COMPENSATION

BACKGROUND OF THE INVENTION

The present invention relates to high speed printers and more particularly to high speed impact printers in which a plurality of magnetic actuators are arranged in a closely spaced array and are repeatedly energized in varying patterns to effect printing from moving type elements, e.g., type elements carried on an endless rotating band.

In high speed band printers, an elongate array of hammers are typically employed to drive paper against a type font embossed on a continuously moving metal loop, the "band." An inked ribbon is normally interposed between the paper and the print elements. To effect printing in this manner, the operations of the hammers must be timed to occur when the desired character is in registration with the respective columnar position on the paper. While most band printers are arranged, e.g., by means of the character spacing on the band, so that it will not be necessary to simultaneously print adjacent characters along the line of print, the magnetic actuators for the hammers, because of their physical size, must typically be arranged in multiple linear banks with successive hammers being driven from the differing banks in rotation. One such hammer and actuator arrangement is disclosed in greater detail in copending coassigned application Ser. No. 509,925 filed on July 1, 1983 by James R. Moss.

With such a banked construction, it is entirely possible that physically adjacent magnetic actuators may be energized during the same print cycle. Since the magnet coils will typically be in close physical proximity, magnetic interaction may occur and the effects caused by this interaction may take any of several forms, each of which can distort the response time of the actuator. Since the type font is continuously moving, it will be readily understood that any change in the response time of the actuator will result in a change in position of the character as printed on the paper. In the particular case of band printers, this variation in response time may cause a displeasing lateral shifting of the printed characters with respect to their neighbors.

While various attempts at magnetic shielding have offered some improvement in these interaction effects, the dense physical packing typically required for the magnetic actuators in band printer has effectively precluded any complete solution by this approach. Accordingly, some prior art printers have gone to a system in which operation of a given actuator is inhibited if adjacent actuators are being energized on the same print cycle. As will be understood by those skilled in the art, however, this solution imposes a severe penalty in throughput since the system must wait for another opportunity to strike the same character. The delay thereby incurred will be dependent upon the distribution of characters on the band and the speed of the band so that multiple passes of the font may be required. Such systems are for example, disclosed in U.S. Pat. No. 4,286,517 and U.S. Pat. No. 4,278,021.

Among the several objects of the present invention may be noted the provision of a high speed impact printer which provides a high degree of columnar alignment; the provision of a high speed band printer employing a dense array of magnetic actuators in which magnetic interaction between actuators does not appreciably disturb columnar alignment; the provision of such a band printer which has high throughput; the provision of such a band printer which is highly reliable and which is of relatively simple and inexpensive construction. Other objects and features will be in part apparent and in part pointed out hereinafter.

SUMMARY OF THE INVENTION

Briefly, a high speed impact printer in accordance with the present invention is of the type in which a plurality of magnetic coils, arranged in a dense array, are energized repeatedly in varying patterns to effect printing. For each magnetic actuator coil, the printer employs a delay circuit which provides a delay which is of programmable duration, the respective coil being energized at the completion of the delay. Also for each coil, the printer employs logic means responsive to the states of energization of physically adjacent coils for programming the respective delay circuit for a delay value which is a predetermined function of those states. Accordingly, magnetic interaction effects caused by the operation of adjacent coils is offset by appropriate variable delays.

BRIEF DESCRIPTION OF THE DRAWINGS

FIG. 4 is a table of programmable delays provided by the circuitry of FIG. 3 in relation to the states of energization of adjacent hammer actuators.

Corresponding reference characters indicate corresponding parts throughout the several views of the drawings.

DESCRIPTION OF THE PREFERRED EMBODIMENT

Figure 1:
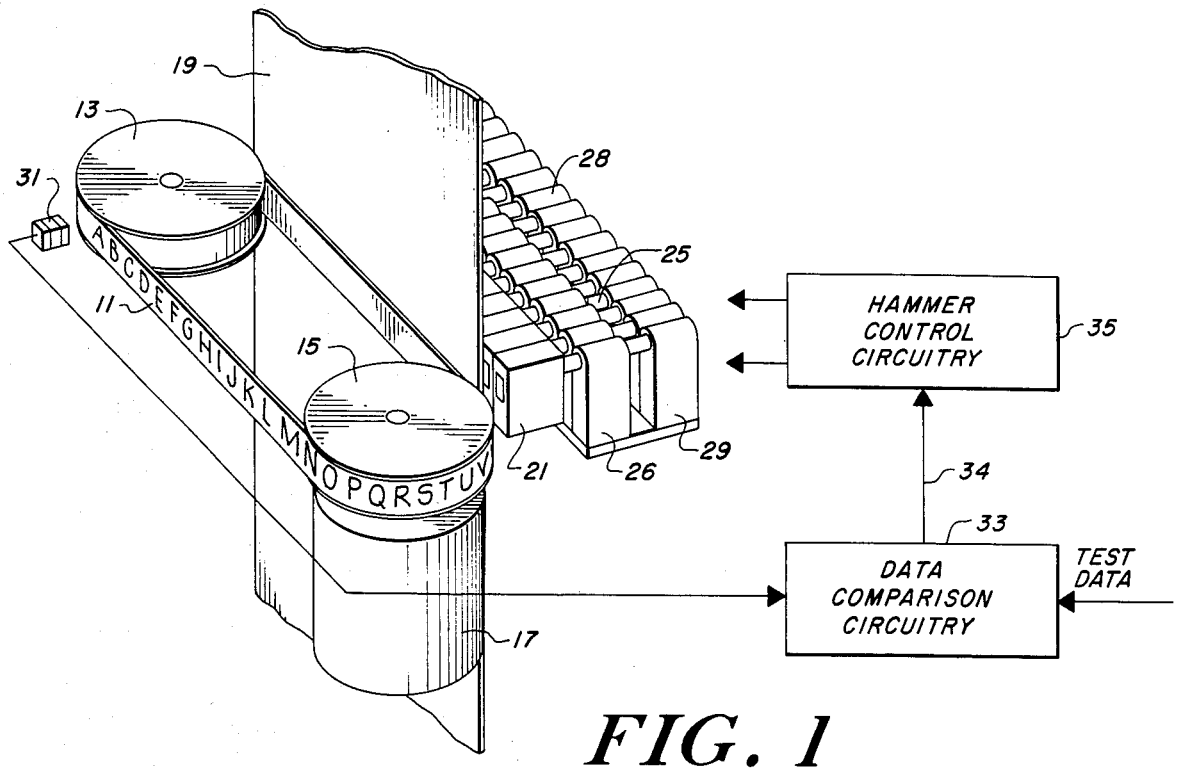
FIG. 1 is a simplified diagramatic illustration, in perspective, of a high speed band printer of the type to which the present invention is applicable.

Referring now to the FIG. 1 diagram of a high speed band printer, it may be noted that an endless type band 11 is trained over a pair of pulleys 13 and 15, one of which is driven by a suitably speed controlled motor 17. One side of the band passes closely adjacent a web of paper 19 on which printing is to be produced. As is understood, a inked ribbon (not shown) is typically interposed between the band and paper. The portion of the band adjacent the paper is typically also backed by a platen (not shown) so as to resist the impact of the print hammers.

A multiplicity of sliding hammers, e.g., one for each columnar position, are held in a hammer guide bar 21 which is mounted on the opposite side of the paper web 19 from the print band. Individual hammers are driven, through push rods 25 from magnetic actuators arranged in two banks 26 and 29. As indicated previously, the required physical size of the actuators is such that they may not be placed in a single linear array with the desired columnar spacing. However, by interleaving the push rods and staggering the actuators, either in upper and lower rows or in axially separated rows or both, the desired close spacing of the hammers themselves may be obtained. A particular actuator construction facilitating such arrangement is described in greater detail in the previously referenced U.S. patent application Ser. No. 509,925, but the present brief description is included to facilitate an understanding of the compensation circuitry which is the subject matter of the present invention.

As is conventional, the print band 11 carries timing marks which may be picked up or detected by one or more magnetic sensors, e.g. as indicated at 31. The timing signals so derived provide sufficient information to the print controlling data comparison circuitry, indicated generally at 33, so that the hammers may be actuated at the necessary times to effect printing of the desired character in each columnar position where printing is to be accomplished.

The circuitry 33 which compares the data representing a line of characters to be printed with the data representing the font on the band 11 is essentially conventional and is not described in detail herein. Basically, however, it may be understood that the control circuitry defines a succession of print cycles during which printing may take place and a control bit is issued for each actuator which is to be fired during that print cycle. Print cycles are performed repeatedly until all requested characters have been printed in the desired columns. As is also understood, the number of print cycles which may be required will vary on a statistical basis depending on the actual text which is to be printed and the position of the print band at the moment printing is initiated for each line of print.

A typical band printer constructed for business purposes will provide for 132 columns of print on each line. Thus, in a hammer per column system, the control circuitry 33 must generate one bit of information for each column, the bit being set or not depending on whether the hammer is to be fired or not, during each print cycle. This information may, in one sense, be thought of as a 132 bit binary word. In actual practice, this binary word is typically generated by the comparison circuitry 33 in serial, i.e., bit sequential, fashion rather than through 132 parallel leads. In FIG. 1, such a serial data path is designated generally by reference character 34. This serial print cycle data is provided to hammer control circuitry, designated generally by reference character 35. The main control circuitry also provide various system clock signals to the hammer control circuitry.

Figure 2:
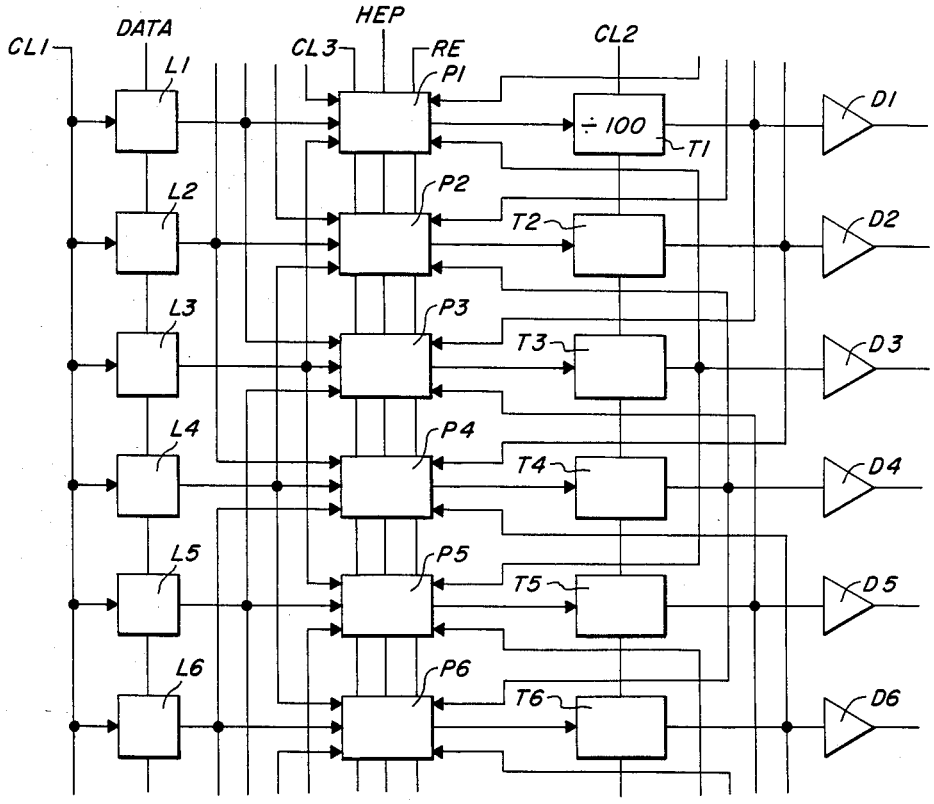
FIG. 2 is a block diagram of digital circuitry implementing the compensation system of the present invention for reducing the effects of magnetic interaction between the magnet coils of the print mechanism of FIG. 1.

In the hammer control circuitry 35 the serial binary word is fed into a shift register comprising a stage or latch for each columnar position or hammer. In FIG. 2 these latches are indicated by reference characters L1–L132. The binary information coming from the control circuitry 33 is applied to the input lead for the shift register which is designated DATA and is clocked in through the shift register by a high speed clock signal applied to the lead indicated as CL1.

For each hammer there is also provided a driver amplifier D1–D132 controlled by an output pulse timer T1–T132. The timers T1–T132 time the duration of the output or energization pulses applied to the magnets and essentially comprise divide-by-100 counters. When initiated by the delay logic circuitry described hereinafter, the timers T1–T132 count down a second high speed clock signal, designated CL2. This clock signal has a period of 13 microseconds so that any coil which is triggered is then energized for a period of about 1300 microseconds.

Triggering of a particular hammer is performed, for each hammer, by programmable delay logic circuitry, these circuits being represented by reference characters P1–P132. In accordance with control criteria described in greater detail hereinafter, each programmable delay logic circuit responds, not only to the state of the latch corresponding to the respective hammer, but also to the states of the latches which correspond to the physically adjacent magnetic actuators and, further, to the current state of actuation of those physically adjacent actuators.

As will be understood by those skilled in the art, successive print cycles in a high speed band printer may occur at relatively closely spaced intervals, i.e., intervals which are comparable in duration to the necessary period of energization of the magnetic actuators themselves. Accordingly, magnetic interaction or interference may occur, not only due to the simultaneous actuation, i.e. turning on of physically adjacent magnets, but also due to the collapse of the field in one magnet, just as another is being energized. In general, it should be understood that if a neighbor is being energized at the same time as a given coil, the magnetic fields will aid each other and both coils will respond more quickly than if no neighbor were being energized. Conversely, if an adjacent magnet coil has just been deenergized when a given coil is being energized, the newly energized coil will respond more slowly than if no activity were taking place in the neighboring magnets. Further, it must be understood that, except for the end actuators in each array, each coil has two neighbors, one on either side, and the pattern of energizations has many possible permutations.

In accordance with the practice of the present invention, each programmable delay circuit P1–P132 provides a programmable delay between the start of the print cycle and the actual start of coil energization and the value of this programmable delay depends not only upon whether either neighbor is to be energized but also depends on whether either or both of the neighbors are currently energized and about to be deenergized. To permit the compensation for either simultaneous energization or deenergization of neighbors, the delay circuits P1–P132 provide for adjustment of the delay around a nominal value. In the embodiment illustrated this delay is 156 microseconds. Thus, with reference to this nominal value, the time at which energization of the respective hammer is started can be either advanced or delayed.

For understanding the operation of the programmable delay circuits, it is convenient to take the fourth stage as a general example, this being the stage which controls the fourth hammer. As may be seen from FIG. 2, the programmable delay circuit P4 has, as inputs, not only the state of the respective latch L4, but also the data from latches L2 and L6. As may be understood from the previous description, these latter latches correspond to the physically adjacent magnetic actuators since the most nearly adjacent character or column positions are driven from actuators located in other banks, as described previously.

In addition to the input signals taken from the data latches, the programmable delay circuit P4 also takes inputs from the outputs of those timer circuits which directly control the energization of the physically adjacent actuators, i.e., timer circuits T2 and T6. These latter signals are used, as indicated previously, to determine whether the neighboring actuators were energized on the previous print cycle and thus are in situations where their magnetic fields will be collapsing as the given actuator is being energized.

As is described in greater detail hereinafter, each of the programmable delay circuits P1–P132 employs digital counter circuitry to effect timing as well as logic to effect the presetting of the counter which combines the various data state signals described previously. For the purpose of this timing operation a common clock signal CL3 is applied to all of the delay circuits P1–P132. In addition, a trigger signal designated for historical reasons as HEP (Hammer Enable Pulse) is applied to each of the programmable delay circuits, this being a signal which initiates each of the delay periods. A common reset signal RE is also provided to each of the programmable delay circuits P1–P132 for resetting the internal counter to a predetermined initial state.

While the particular delays which may be appropriate to offset the various permutations of magnetic interactions will depend upon the particular magnetic construction and physical orientation of the magnetic actuators, a particular set of delays which have been found appropriate for the type of actuator construction shown in FIG. 1 are set forth in the Table of FIG. 4, the fourth stage being again used as a representative or general example.

As noted previously, the nominal delay is 156 microseconds. This delay is used when there is essentially no magnetic interaction or the magnetic interactions are offsetting, e.g., one neighbor is being energized while the magnetic field of the other neighbor is collapsing. As may be seen from FIG. 4, the maximum delay occurs when both neighbors are being energized at the same time as the hammer in question, i.e. when the coil of the actuator being considered is being aided by both neighbors. In this case, since the actuator will respond more quickly due to the aiding magnetic intercoupling, a delay of 247 microseconds is applied before energizing the coil in question in order to offset or compensate for the quicker response time. Conversely, if both neighbors had been energized in the previous print cycle so that both adjacent magnetic fields may be collapsing, the delay is reduced from the nominal to a shorter setting, i.e., to 78 microseconds so that the actuator is, in effect, given a headstart to offset or compensate for the delaying effects of the collapsing magnetic fields of the adjacent actuators. Where only one of the neighbors being energized at the same time, an intermediate lengthening of the delay is provided, i.e., to 208 microseconds. Similarly, where the only adjacent activity is that one of the neighbors is being deenergized, an intermediate shortening of the nominal delay is effected, i.e. to 117 microseconds.

Figure 3:
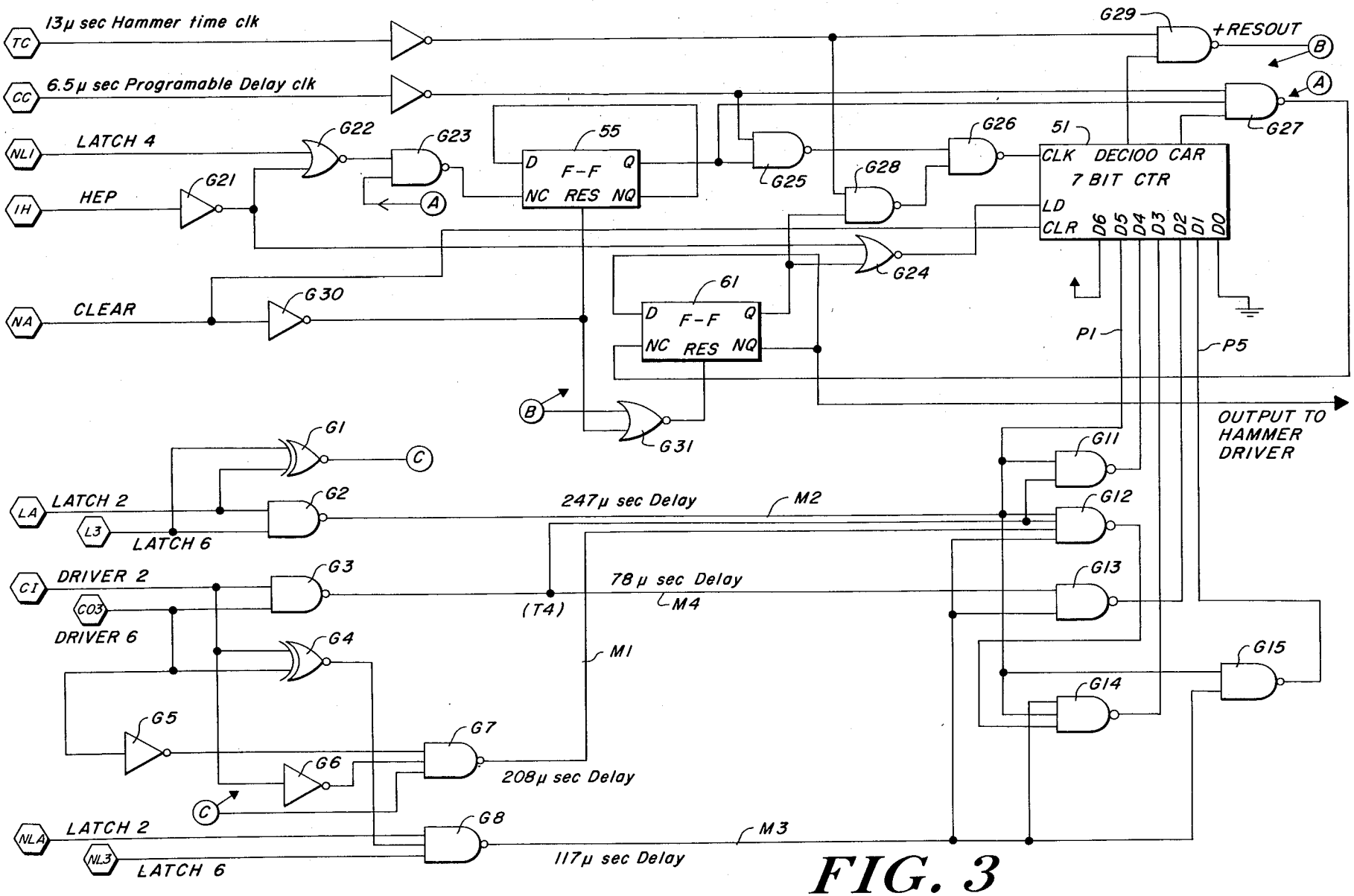
FIG. 3 is a more detailed logic diagram of programmable delay and timing circuitry employed in the system of FIG. 2.

For the purpose of illustration and description, the functional block diagram of FIG. 2 shows the programmable delay circuitry and the output pulse timers as separate elements. While it is entirely practical to construct a system in utilizing separate counters for these two different timing functions, the presently preferred embodiment in fact utilizes a single digital counter shared between these two functions. Such sharing is possible since the two timing functions occur sequentially rather than simultaneously in the circuitry for any given stage. With reference to FIG. 3, the shared circuitry is a 7-bit binary counter, designated by reference character 51. Two separate clock signals are available to the counter, a 6.5 microsecond clock which is used during the programmable delay and a 13 microsecond clock which is used during the hammer energization timing. It should be noted that, in FIG. 3, certain connections or data paths have indicated by corresponding letters, i.e. A through C, so as to avoid long lead lines which would obscure the drawing.

An array of gates G1–G8 is employed in a combinatorial arrangement to, in effect, generate the truth table of FIG. 4 using the four input signals which represent the states of the neighboring actuators. The array generates four discrete outputs M1–M4 which represent the four adjusted time values. A second array of logic gates G11–G15 employs these discrete delay signals to encode or generate a set of five signals P1–P5 which represent corresponding preset values for the binary counter 51.

Initiation of the delay mode is effected by the application of the HEP pulse in coincidence with a true or set signal being provided from the respective data latch, these signals being applied, through gates G21–G23 to the clock input of a D-type flipflop 55 which is interconnected as a resettable latch. The HEP signal also is applied, through a gate G24 to the load input of the binary counter 51 to cause it to acquire the preset delay value. The output from the latch 55 is employed, through logic gates G25 and G26 to gate the 6.5 microsecond clock to the clock input of the binary counter 51.

Once the counter 51 has been preset and the clock applied, the counter counts out the corresponding predetermined interval, a CARRY signal being generated at the end of the period. This CARRY signal is applied, through a gate G27, which effects synchronization with the clock signals, to a second D-type flipflop 61, this flip-flop also being interconnected as a latch. The complemented output signal from the latch 61, when set, constitutes the output to the respective hammer driver amplifier. The setting of the latch 61 also controls, through gate G28, the application of the 13 microsecond clock to the binary counter 51. Accordingly, the counter is advanced from its zero state at the slower rate. The counter itself includes an output, designated DEC 100, which goes TRUE when a count of 100 is reached. The presence of this signal, through gates G29 and G31, causes a RESET signal which is employed to initiate resetting of the flip-flop 61 and the counter 51, thereby ending the energization of the respective hammer.

In the embodiment illustrated, only the immediate neighbors in the same linear array of actuators produce magnetic interaction of a level necessitating a compensating adjustment. It should be understood, however, that the technique of the present invention can be extended to include neighbors which are further away in the same array or in adjacent arrays if the arrays are so closely packed that this magnetic interaction causes noticeable effects in the columnar alignment of the printing.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. In a high speed impact printer in which a plurality of magnet coils are arranged in an array and are energized repeatedly in varying patterns thereby to effect printing, a compensation system for magnetic interaction between the coils comprising:

for each coil, a respective input circuit which may be actuated to represent that the coil is to be energized on the current print cycle;

for each coil, means for providing a delay which is of programmable duration;

for each coil, means for energizing the respective coil at the completion of the respective delay;

for each coil, logic means responsive to the state of the respective input circuit and to the states of the input circuits for physically adjacent coils for programming the respective delay means to a delay value which is a predetermined logical function of said states, whereby interaction effects between said coils may be offset by varying delays.

2. In a high speed impact printer in which a plurality of magnet coils are arranged in an array and are energized repeatedly in varying patterns thereby to effect printing, a compensation system for magnetic interaction between the coils comprising:

for each coil, means for providing a delay which is of programmable duration;

for each coil, means for energizing the respective coil for a predetermined time interval at the completion of the respective delay;

for each coil, logic means responsive to the states of energization of physically adjacent coils for programming the respective delay means to a delay value which is a predetermined function of said states, whereby interaction effects caused by the collapsing magnetic field of adjacent coils may be offset by variable delays.

3. In a high speed impact printer in which a plurality of magnet coils are arranged in an array and are energized repeatedly in varying patterns thereby to effect printing, a compensation system for magnetic interaction between the coils comprising:

for each coil, a respective latch which may be set to represent that the coil is to be energized on the current print cycle;

for each coil, a delay circuit including a programmable digital counter for providing a delay which is of adjustable duration;

for each coil, means for energizing the respective coil at the completion of the delay provided by the respective delay circuit;

for each coil, digital logic means responsive to the state of the respective latch and to the states of the latches for physically adjacent coils for programming said counter for a delay value which is a predetermined logical function of said states providing for longer delays when physically adjacent coils are simultaneously energized.

4. In a high speed impact printer in which a plurality of magnet coils are arranged in an array and are energized repeatedly in varying patterns thereby to effect printing from moving type elements, a compensation system for magnetic interaction between the coils comprising:

for each coil, a respective latch which may be set to represent that the coil is to be energized on the current print cycle;

for each coil, a delay circuit including a programmable digital counter for providing a delay which is of adjustable duration;

for each coil, means for energizing the respective coil for a predetermined time interval at the completion of the delay provided by the respective delay circuit;

for each coil, digital logic means responsive to the states of energization of physically adjacent coils for programming said counter for a delay value which is a predetermined function of said states providing for shorter delays when physically adjacent coils are being de-energized essentially simultaneously with the energization of the respective coil whereby interaction effects caused by the collapsing magnetic field of adjacent coils may be offset by variable delays.

5. A compensation system as set forth in claim 4 wherein said means for energizing utilizes, for timing said interval, said programmable counter.

6. In a high speed impact printer in which a plurality of magnet coils are arranged in an array and are energized repeatedly in varying patterns thereby to effect printing from moving type elements, a compensation system for magnetic interaction between the coils comprising:

for each coil, a respective input circuit which may be actuated to represent that the coil is to be energized on the current print cycle;

for each coil, means for providing a delay which is of programmable duration;

for each coil, means for energizing the respective coil for a predetermined time interval at the completion of the respective delay;

for each coil, logic means responsive to the state of the respective input circuit, to the states of the input circuits for physically adjacent coils, and to the states of energization of physically adjacent coils for programming the respective delay means to a delay value which is a predetermined logical function of said states, whereby interaction effects between said coils may be offset by varying delays.

7. In a high speed impact printer in which a plurality of magnet coils are arranged in an array and are energized repeatedly in varying patterns thereby to effect printing from moving type elements, a compensation system for magnetic interaction between the coils comprising:

for each coil, a respective latch which may be set to represent that the coil is to be energized on the current print cycle;

for each coil, a delay circuit including a programmable digital counter for providing a delay which is of adjustable duration;

for each coil, means for energizing the respective coil for a predetermined time interval at the completion of the delay provided by the respective delay circuit;

for each coil, digital logic means responsive to the states of energization of physically adjacent coils for programming said counter for a delay value which is a predetermined function of said states providing for shortening the delay when a physically adjacent coil is being de-energized essentially simultaneously with the energization of the respective coil and for lengthening the delay when a physically adjacent coil is being energized essentially simultaneously with the energization of the respective coil whereby interaction effects caused by the operation of adjacent coils may be offset by variable delays.

* * * * *